US006648430B2

(12) United States Patent
Rohde et al.

(10) Patent No.: US 6,648,430 B2
(45) Date of Patent: Nov. 18, 2003

(54) TABLE WITH IMPROVED WHEELCHAIR ACCESSIBILITY

(75) Inventors: Jane M. Rohde, Ellicott City, MD (US); Charles M. Beavan, Ellicott City, MD (US)

(73) Assignee: Patapsco Woodworks, Inc., Ellicott City, MD (US)

( * ) Notice: Subject to any disclaimer, the term of this patent is extended or adjusted under 35 U.S.C. 154(b) by 0 days.

(21) Appl. No.: 10/145,621

(22) Filed: May 9, 2002

(65) Prior Publication Data

US 2002/0185946 A1 Dec. 12, 2002

Related U.S. Application Data

(60) Provisional application No. 60/289,546, filed on May 9, 2001.

(51) Int. Cl.[7] ..... A47B 97/00
(52) U.S. Cl. ..... 312/301; 108/90; 312/291
(58) Field of Search ..... 312/246, 287, 312/291, 301, 277, 194; 108/25, 26, 69, 90, 93, 96, 157.13

(56) References Cited

U.S. PATENT DOCUMENTS

| | | | | | |
|---|---|---|---|---|---|
| 2,229,320 | A | * | 1/1941 | Balzano et al. | 108/75 |
| 2,986,437 | A | * | 5/1961 | Davis | 108/157.13 |
| 4,384,532 | A | * | 5/1983 | Staff | 108/72 |
| 5,248,192 | A | * | 9/1993 | Tazzia | 312/194 |
| 5,341,749 | A | * | 8/1994 | Noakes | 108/64 |
| 5,444,928 | A | * | 8/1995 | Sagel | 38/139 |
| 5,743,194 | A | * | 4/1998 | Ziegeler | 108/157.13 |
| 5,848,828 | A | * | 12/1998 | MacLellan | 312/291 |

* cited by examiner

*Primary Examiner*—Janet M. Wilkens
(74) *Attorney, Agent, or Firm*—Edell, Shapiro & Finnan, LLC

(57) ABSTRACT

A table with improved wheelchair accessibility includes a bridge member securable in a selected alignment with the tabletop to extend a supporting surface of the table between the armrest sections of a wheelchair. The bridge member includes a supporting surface that is substantially coplanar with the supporting surface of the tabletop when the bridge member is secured in the selected alignment with the tabletop.

22 Claims, 5 Drawing Sheets

TABLE WITH IMPROVED WHEELCHAIR ACCESSIBILITY

CROSS REFERENCE TO RELATED APPLICATIONS

This application claims priority from U.S. Provisional Patent Application Ser. No. 60/289,546, entitled "Table With Improved Wheelchair Accessibility," filed May 9, 2001. The disclosure of this provisional patent application is incorporated herein by reference in its entirety.

BACKGROUND OF THE INVENTION

1. Field of the Invention

The present invention relates to tables that are accessible to individuals confined to a wheelchair. In particular, the present invention relates to tables configured to accommodate the dining and/or activity needs of wheelchair-confined individuals.

2. Description of the Related Art

Many persons who are confined to wheelchairs temporarily or for extended periods of time have need for a table that allows them to dine, study or write, or participate in other activities, either with other persons or individually. Conventional tables designed for use by wheelchair-confined persons are useful only for such persons and, in a public or institutional setting, create a stigma by directing the wheelchair-confined person(s) to the specifically designed tables.

Various adjustable height dining and/or activity tables currently on the market are designed for use by wheelchair-confined individuals. One disadvantage of these tables is that they cannot serve both wheelchair confined and non-confined persons simultaneously. Specifically, when the table is adjusted to a height of about 29–30 inches, the armrest sections of the wheelchair do not have clearance under the horizontal table top surface, leaving the seat of the wheelchair and thus the wheelchair individual too far from the edge of the table, which makes daily activities such as eating very cumbersome, messy and undignified. In many cases, a resident in a care facility will need a bib to protect the path of a soup spoon from the table to his or her mouth. Another disadvantage is that when the tables are adjusted to a height that allows clearance over wheelchair arms, the table height is no longer in the proper ergonomic relationship to the seated individual. Further, table height adjustment is designed to be performed by staff, thereby limiting the independence of the wheelchair-confined individual. Still another disadvantage is that many of these modified tables offer few, if any, rectangular adjustable solutions, which may limit space planning options.

To be suitable for the intended purpose, a table should be light and, if desired, mobile. Individuals should be able to sit wherever desired and adjust the table on their own to accommodate their needs. A variety of sizes will allow for maximum use of the space.

SUMMARY OF THE INVENTION

Therefore, in light of the above, and for other reasons that become apparent when the invention is fully described, an object of the present invention is to provide a table that is accessible for simultaneous use by wheelchair-confined and non-confined individuals.

It is another object of the present invention to provide a table that is easily adjustable by a wheelchair-confined individual to render the table accessible for use by that individual.

It is a further object of the present invention to provide a table that is easy to transport for use at a variety of locations.

The aforesaid objects are achieved individually and in combination, and it is not intended that the present invention be construed as requiring two or more of the objects to be combined unless expressly required by the claims attached hereto.

In accordance with the present invention, a table with improved wheelchair accessibility includes a bridge member securable in a selected alignment with the tabletop to extend a supporting surface of the table between the armrest sections of a wheelchair. The bridge member includes a supporting surface that is substantially coplanar with the supporting surface of the tabletop when the bridge member is secured in the selected alignment with the tabletop. In an exemplary embodiment, the table includes a drawer to support the bridge member in the selected alignment with the tabletop, and securing members are provided on the bridge member to prevent or limit the degree of sliding movement of the bridge member with respect to the tabletop and the drawer.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF THE PREFERRED EMBODIMENTS

Figure 1:
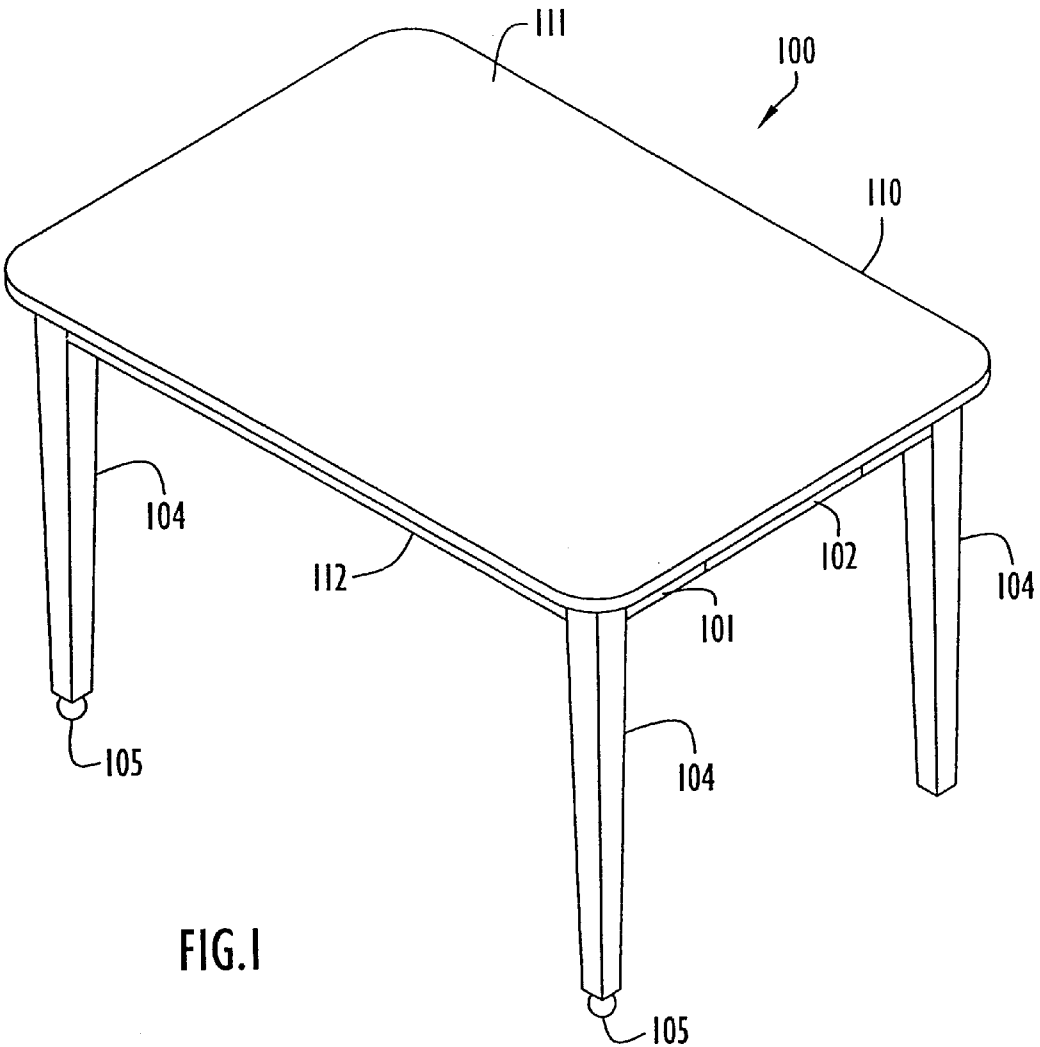
FIG. 1. is a top view in perspective of a wheel chair access table in accordance with the present invention.
Figure 2:
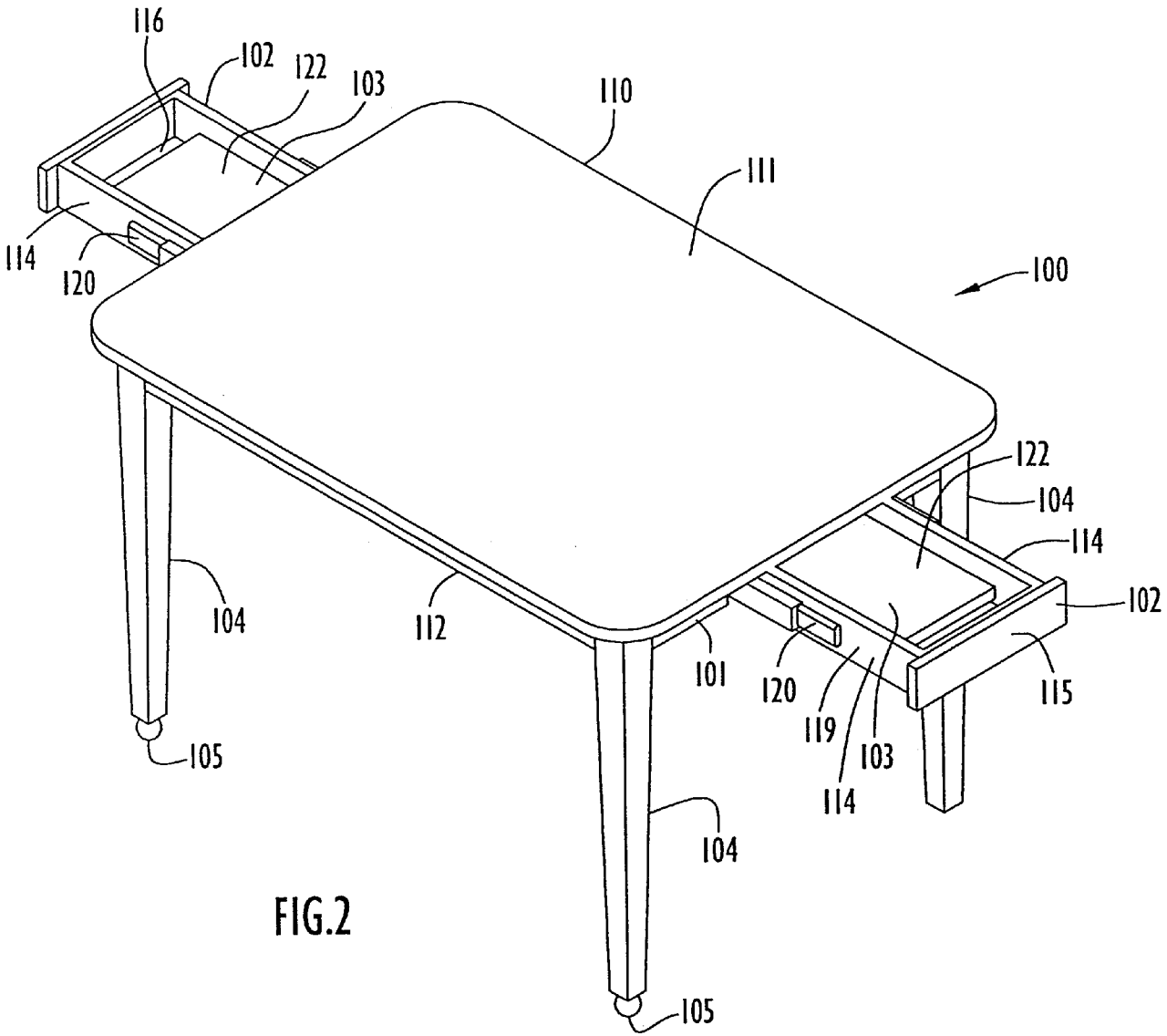
FIG. 2 is a top view in perspective of the table of FIG. 1 with drawers in open positions with respect to the tabletop.
Figure 3:
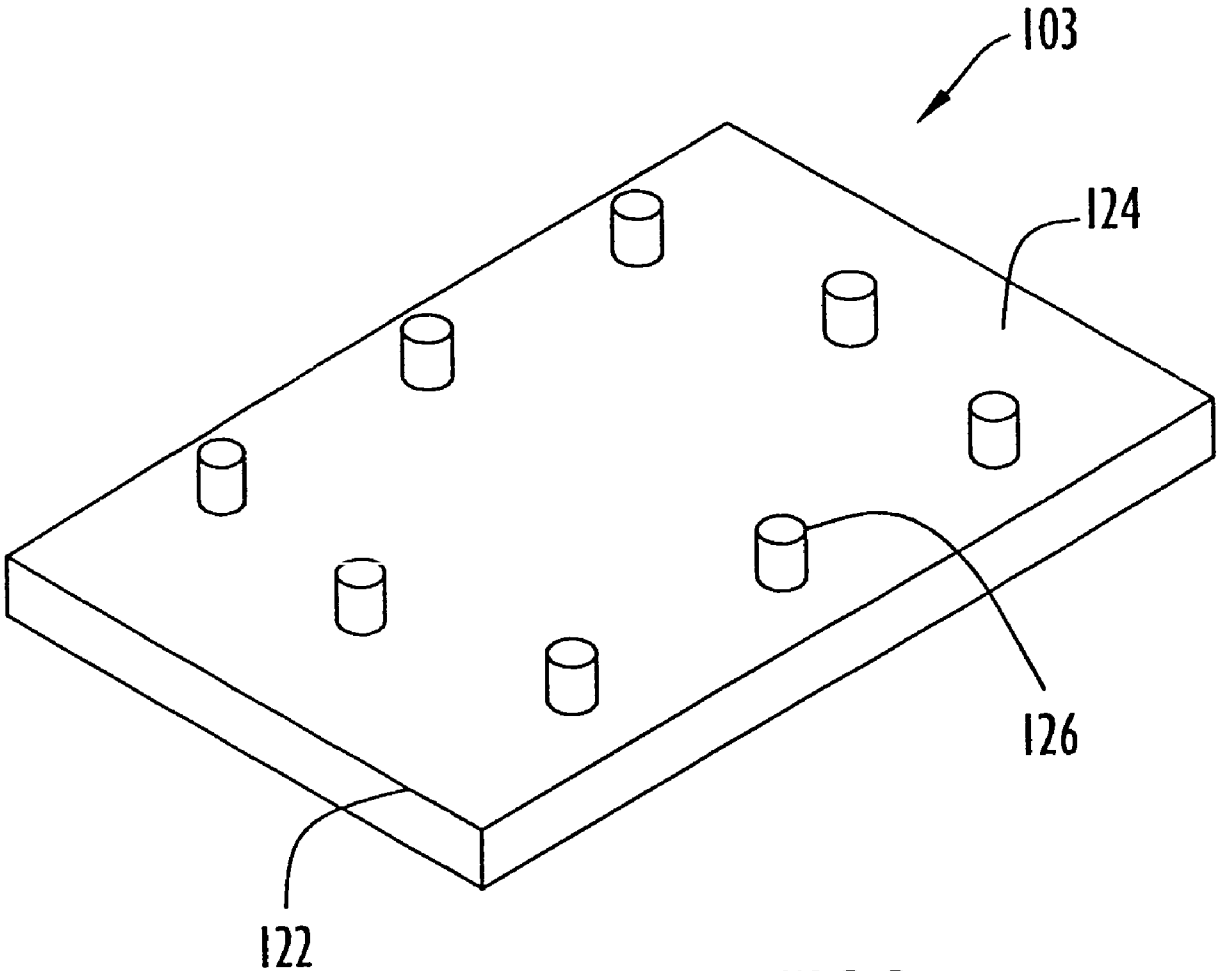
FIG. 3 is a bottom view in perspective of an exemplary bridge member in accordance with the present invention.

An exemplary wheelchair accessible table in accordance with the present invention is illustrated in FIGS. 1–3. Unless indicated otherwise, the table is constructed of wood (e.g., oak, pine, plywood, etc.) or any other material suitable for constructing a table. Preferably, the table is constructed of a lightweight material to facilitate easy moving of the table between various locations. Referring to FIG. 1, table 100 includes a generally rectangular tabletop 110 having a substantially flat upper surface 111 for supporting items to be placed on the table and a lower surface 112 that faces the floor or other supporting surface for the table when the table is being used. Exemplary dimensions for the tabletop are 41 inches by 45 inches. However, the tabletop may be dimensioned for any suitable size and/or geometric configuration (e.g., square, circular, etc.) to accommodate any number of wheelchair-confined and/or non-confined individuals.

Four legs 104 are secured to and extend away from the lower surface 112 at the four corners of the tabletop 110 to support the table at a suitable distance from the floor. Alternatively, any other suitable number (e.g., one) of legs may be provided to support the tabletop. An exemplary length of each leg is in the range of about 25–30 inches, resulting in tabletop 110 being supported at a distance above the floor that is within a range typical of conventional tables. However, it is noted that the lengths of the table legs may be of any suitable dimensions. Two of the legs 104 located on the same side of the table each includes a caster 105 disposed at a terminal end of the leg so as to contact the floor. Each caster 105 has a substantially spherical geometric configuration and is constructed of a suitable material (e.g., wood or metal) to facilitate easy rolling or sliding of the casters on a hard and/or soft surface when the table is moved between different locations. Alternatively, it is noted that the table may include any suitable number of casters disposed on any one or more of the legs to assist in moving the table along such surfaces.

An apron 101 also extends at a suitable length (e.g., about 3–4 inches) from the tabletop lower surface 112 and along the periphery of the tabletop 110. The apron includes a series of thin and generally rectangular apron sections extending along each side of the tabletop between opposing legs 104. Two of the apron sections on opposing sides of the tabletop include generally rectangular cut-out portions to receive and permit movement of a pair of drawers 102 from closed to open positions with respect to the tabletop as described below.

The drawers 102 that are disposed between the apron sections defining the cut-out portions provide supporting surfaces for extending a bridge member 103 between the tabletop upper surface 111 and a wheelchair-confined individual when each drawer is in an open position with respect to the tabletop. Referring to FIG. 2, each drawer 102 has a generally rectangular configuration and includes a pair of opposing side walls 114 extending substantially the entire longitudinal dimension of the drawer, a front wall 115 and an opposing rear wall (not shown) extending substantially the entire width or transverse dimension of the drawer, and a bottom wall 116. The front, rear, bottom and side walls basically define a storage pocket for the bridge member 103. The side walls and front and rear walls of each drawer are further suitably dimensioned such that, when the drawer is in a fully closed position as depicted in FIG. 1, the drawer rests directly below the tabletop lower surface 112 with the front wall 115 resting within the cut-out portion of a corresponding apron section and substantially flush or coplanar with the apron sections defining the cut-out portion. Preferably, each front wall 115 is further suitably dimensioned to substantially occupy the cut-out portion and not extend beyond a lower edge of the apron sections defining the cut-out portion so as to appear generally integral with the apron sections when the drawer is in the fully closed position. In addition, the transverse dimension of each drawer is preferably less than the typical distance between armrest sections of a wheelchair to be used in combination with table 100 so as to permit extension of the drawers from the tabletop within a space defined between those armrest sections. Optionally, the front wall 115 of each drawer may include a handle, knob, or other suitable gripping device to facilitate opening of the drawer. The drawer front wall can also be designated as a wayfinder for those needing visual or tactile guidance to an appropriate seating location at the table. This may be accomplished by providing a contrasting color or tactual finish to the drawer front wall.

Each drawer 102 is suspended in a fixed spatial arrangement with respect to the tabletop lower surface 112 via a set of rail members 120 disposed on and extending longitudinally along the outer surfaces of the side walls 114. Corresponding rail members (not shown) are mounted at or proximate the lower surface 112 of the tabletop 110 in the area of the cut-out portions of the apron sections and are suitably aligned to receive and engage the rail members disposed on the drawers so as to permit sliding movement of the drawers between open and closed positions with respect to the tabletop. For example, the corresponding rail members may be mounted on facing surfaces of two generally rectangular support members attached to the tabletop lower surface 112 and extending between the two opposing sides of the tabletop from which the drawers extend. However, it is noted any suitable rail member or other securing mechanism for supporting the drawers and permitting their movement between open and closed positions with respect to the tabletop may be utilized.

Disposed within each drawer 102 is a generally rectangular bridge member 103 that includes an upper surface 122 for supporting items during use and a lower surface 124 including bumpers 126 to stabilize and secure the bridge member between the drawer and the tabletop when utilized as described below. As used herein, the term "secure", when used in connection with the bridge member, refers to the bridge member being positionally constrained with respect to the drawer. Each bridge member 103 is suitably dimensioned to fit within and rest upon the bottom wall 116 of a corresponding drawer 102 when the longitudinal dimension of the bridge member is aligned with the longitudinal dimension (i.e., distance between the front wall 115 and the rear wall) of the drawer. The longitudinal dimension of each bridge member 103 is also larger than the transverse dimension of the drawer (i.e., the distance between the side walls 114) of the corresponding drawer such that, when the bridge member is oriented with its longitudinal dimension transversely of the longitudinal dimension of the drawer, the bridge member will rest upon the top edges of the drawer side walls 114. Each bridge member further includes a suitable thickness such that, when the bridge member rests upon the top edges of drawer side walls 114, the top surface 122 of the bridge member resides in a plane that is substantially flush or coplanar with the top surface 111 of the tabletop 110.

The dimensions of the bridge members are preferably selected to correspond with industry standard dimensions for a dining tray utilized in restaurants, cafeterias, hospitals, nursing homes and various other facilities. The longitudinal dimension of each bridge member is also preferably less than the distance between the armrests of a wheelchair utilized with the table 100 such that, when resting upon the side walls 114 of an open drawer 102, the bridge member will fit between the armrest sections of the wheel chair. Alternatively, the longitudinal dimension of the bridge member may be greater than the distance between the wheelchair armrest sections if the table is configured such that the top edges of the drawer side walls are situated above the armrest sections. In such an embodiment, the bridge member would rest on the drawer side walls and extend over the wheel chair armrest sections during use of the table by a wheelchair-confined individual. Exemplary longitudinal dimensions for a suitable bridge member include, without limitation, 16–20 inches.

Each bridge member 103 includes a series of generally cylindrical bumpers 126 secured at varying locations to and extending away from the lower surface 124 of the bridge member. The bumpers are preferably constructed of a suitable resilient material (e.g., rubber) to provide a cushioning engagement between the tabletop, bridge member, and drawer when the bridge member is positioned on the top edges of the drawer side walls 114 as described below. An exemplary arrangement of eight bumpers 126 on a bridge member lower surface 124 is illustrated in FIG. 3. However, it is noted that any suitable arrangement and number of bumpers may be provided to secure and stabilize the bridge member during use. In addition, the bumpers are preferably of a suitable length so as to provide a sufficient gap between the lower surface of the bridge member and the bottom wall of the drawer when the bridge member rests within the drawer with the bumpers facing the bottom wall. This feature allows an individual, particularly one who is elderly or handicapped, to easily remove the bridge member from the drawer for use by inserting the individual's fingers within the gap to obtain an appropriate grip on the bridge member.

Referring to FIG. 3, a set of three bumpers 126 is secured in a substantially linear and evenly spaced arrangement along the peripheral edge of each opposing longitudinal side of the bridge member. Each set is further centered with respect to the longitudinal dimension of the bridge member lower surface 124 and has a total length, as defined by the distance between the outermost bumpers of the set, that is smaller than the shorter dimension of its corresponding drawer 102. A single bumper 126 is substantially centered along each shorter side of the bridge member lower surface 124, with the distance between the two single bumpers being slightly smaller than the shorter dimension of the corresponding drawer. Thus, the spacing of the bumpers 126 permits the bridge member 103 to be placed on its corresponding drawer 102 with the bridge member lower surface 124 engaging the top edges of the drawer side walls 114 when the longitudinal dimension of the bridge member is substantially perpendicular to the longitudinal dimension of the drawer. Further, in this arrangement, each of the bumpers 126 is disposed between the side, front and rear walls of the drawer, and at least the single bumpers disposed on the bridge member shorter sides prohibit or limit the degree of sliding movement of the bridge member with respect to the drawer side walls when the bridge member is supported on the drawer side walls.

Figure 4A:
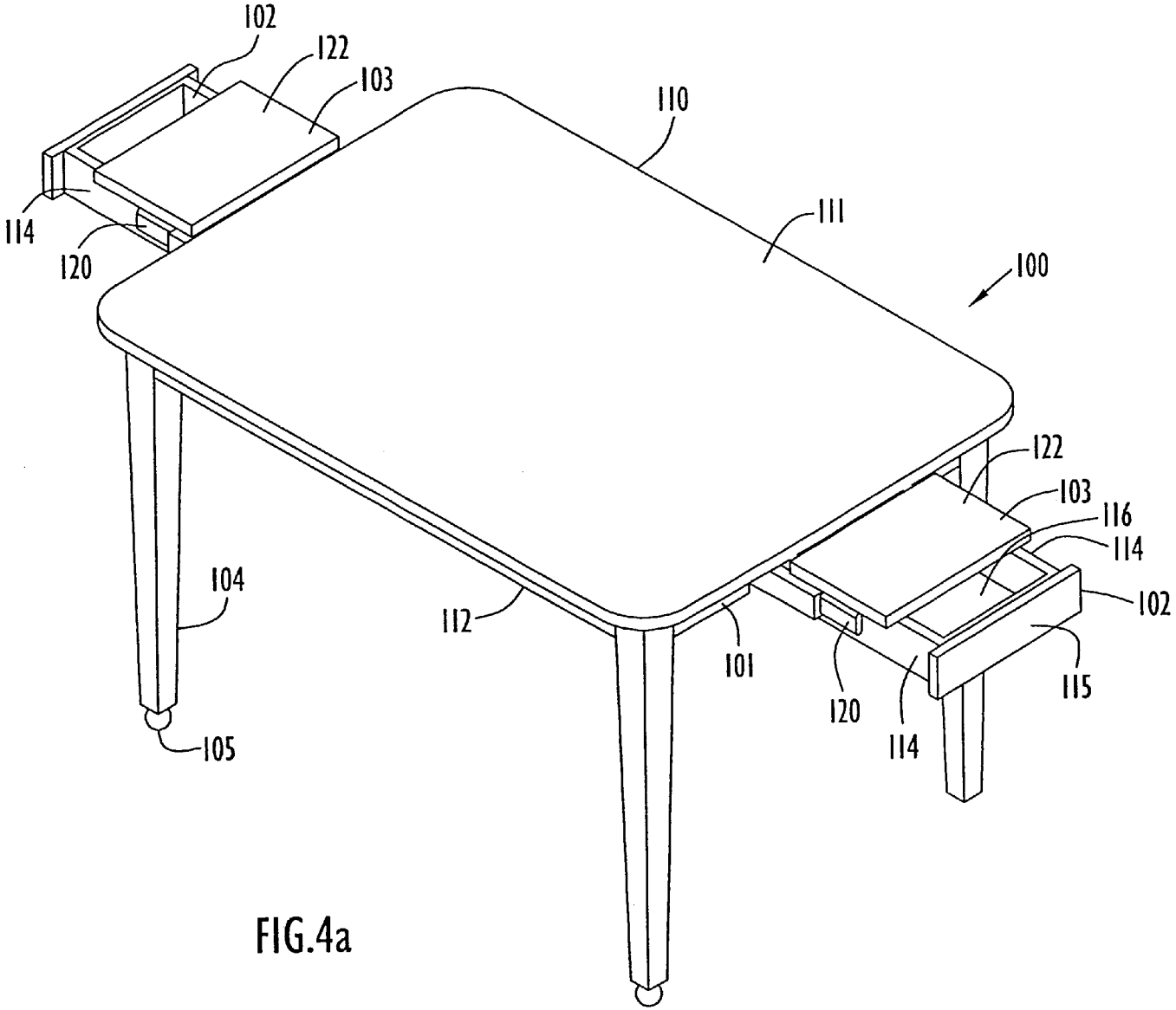
FIGS. 4*a*–4*b* are top views in perspective of the table of FIG. 1 with the drawers open at different positions including bridge members supported by the drawers in accordance with the present invention.
Figure 4B:
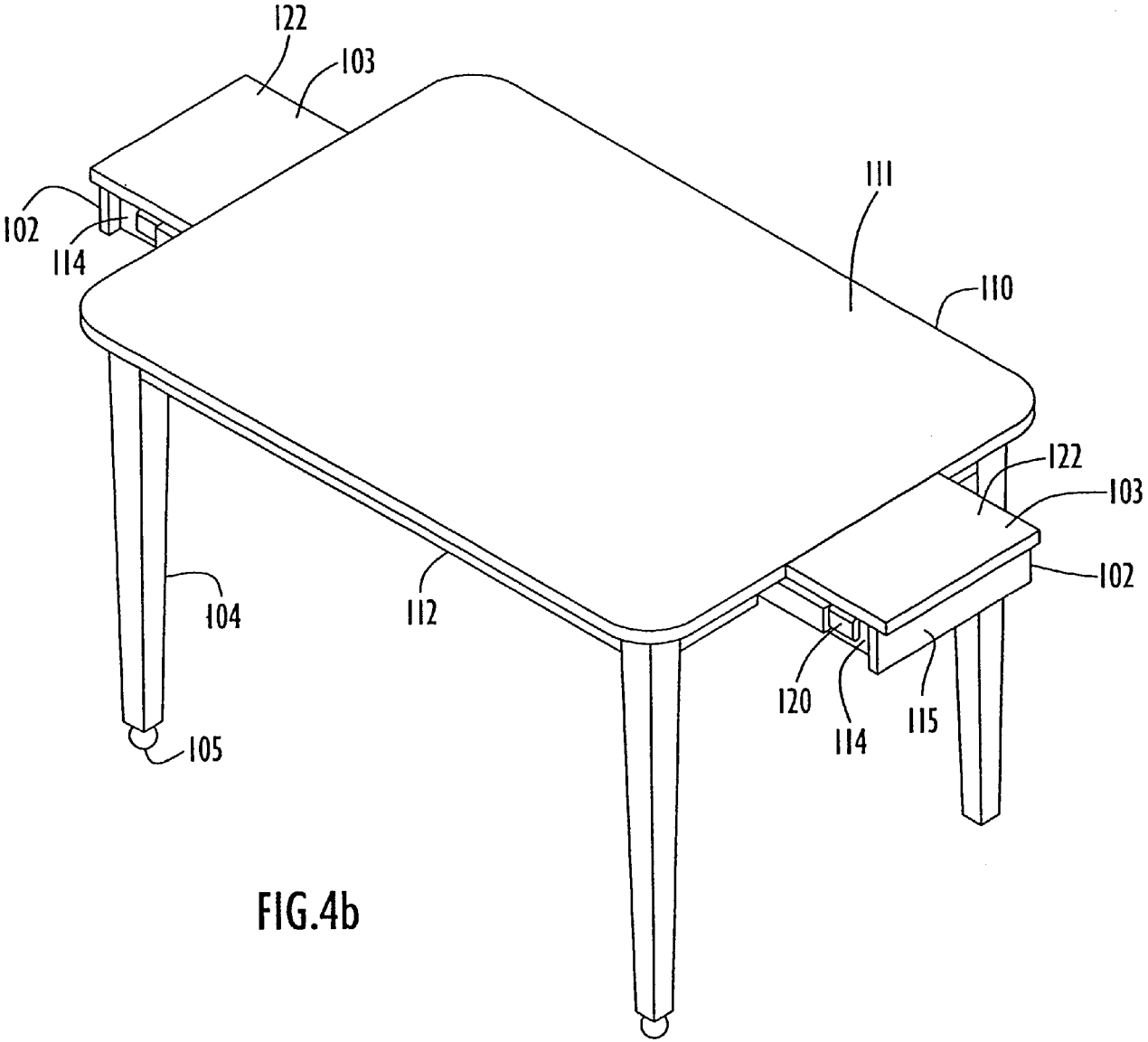

Operation of the table 100 is illustrated in FIGS. 4*a* and 4*b*. When a wheelchair-confined individual desires to utilize table 100, the wheelchair is positioned proximate the tabletop 110 and suitably aligned to receive one of the drawers 102 between the armrest sections of the wheelchair. In an exemplary scenario, the wheelchair and table 100 are designed with conventional dimensions such that the armrest sections of the wheelchair will abut either the tabletop 110 or the apron 112 thus limiting the proximity that can be achieved between the wheelchair-confined individual and the tabletop. The drawer 102 is opened by pulling it in a direction away from the tabletop so as to expose the bridge member 103 disposed within the drawer. The bridge member is removed from the drawer, positioned with its lower surface 124 facing the drawer, and placed upon the top edges of the drawer side walls 114 such that the longitudinal dimension of the bridge member is generally perpendicular with the longitudinal dimension of the drawer as depicted in FIG. 4*a*. In this position, the bumpers 126 aligned along the shorter sides of the bridge member limit the degree of sliding movement of the bridge member between the drawer side walls.

Upon placement of the bridge member on the side walls of the drawer, the drawer is moved toward the tabletop 110, by sliding the rail members 120 along their corresponding rail members disposed below the tabletop lower surface 112, until the drawer reaches a partially open position that secures the bridge member in a fixed position as depicted in FIG. 4*b*. In this fixed position, the bumpers 126 disposed along a longitudinal side of the bridge member engage the front wall 115 of the drawer to prevent sliding movement of the bridge member away from the tabletop 110, and the peripheral edge of the opposing longitudinal side of the bridge member engages a facing peripheral edge of the tabletop to prevent sliding movement of the bridge member toward the tabletop. Thus, the bridge member is secured against the tabletop, with the bridge member upper surface 122 being substantially coplanar with the tabletop upper surface 111, effectively providing a bridge from the table top surface to the wheelchair-confined individual. The wheelchair-confined individual is able to move forward to a position where the bridge member is disposed over the wheelchair seat and proximate the individual's stomach or chest.

The bridge member 103 may be easily removed from the fixed position illustrated in FIG. 4*b* by pulling the drawer 102 away from the tabletop 110, removing the bridge member from the drawer side walls 114 and placing the bridge member back into the drawer. The drawer may be closed to allow non-confined individuals to sit and utilize the table at the drawer location. In addition, both drawers may be simultaneously utilized by two wheelchair-confined individuals.

The bridge member of the table allows for a working, activity, or eating space to be created between the arms of the wheelchair for the individual user. The bridge member further enables the proper relationship of seating height to arm height to be maintained for wheelchair-confined individuals, and minimizes the possibility that items, placed so as to inadvertently span both the table and bridge surfaces, will be prone to tip and/or spill. The bumpers of the bridge member are symmetrically disposed along the lower surface of the bridge member to allow the bridge member to be placed on the drawer side walls and secured in the manner described above without the requirement of aligning a specific longitudinal side of the bridge member in relation to the drawer or tabletop.

The design of the table allows wheelchair-confined individuals to employ the bridge member without any assistance from others. The drawer dimensions are directly related to the size of the stored bridge member and the ease with which an individual with limited use of his/her hands can still remove the bridge member from the extended drawer and properly deploy the bridge member. Further, the table may be configured with a conventional design that provides a non-stigmatizing approach to accessibility by allowing multiple wheelchair-confined and non-confined individuals to simultaneously use the table.

It will be appreciated that the embodiments described above and illustrated in the drawings represent only a few of the many ways of implementing a table with improved wheelchair accessibility.

The table may be constructed of any one or more suitable materials and include a tabletop having any suitable geometric configuration including, without limitation, square, rectangular, circular and oval configurations. Any suitable number of legs (e.g., one) may be provided to support the tabletop. Additionally, any number of casters, wheels, or other suitable floor-engaging members may be provided on one or more of the table legs to facilitate easy transport of the table along a floor or other supporting surface.

Any number of drawers (e.g., one) may be provided with any suitable dimensions and at any suitable locations along the table for forming a bridge between the tabletop upper surface and the wheelchair-confined individual. For example, in the embodiment illustrated in FIGS. 1–4, one or more drawers with similar or varying dimensions may be positioned on each side of the tabletop to permit multiple wheelchair-confined individuals to simultaneously utilize the bridging features of the table. The drawers may be movably secured to the tabletop in any suitable manner to permit positioning of the drawers in open and closed positions. Any table may be manufactured with drawers suitable for supporting bridge members, or, alternatively, any existing table may be retrofitted with drawers that are configured to support bridge members in accordance with the present invention. For example, an existing table including an apron can be retrofitted by cutting out selected portions of the apron and installing rail or other suitable supporting members for the drawer. Alternatively, a prefabricated apron or drawer structure may be retrofit onto the existing table. Other ways of retrofitting an existing table to provide a drawer structure suitable for supporting a bridge member in accordance with the present invention will be recognized by those skilled in the art.

The bridge members may have any suitable dimensions for providing a bridge between the tabletop surface and a wheelchair-confined individual. The bridge members may include any suitable number of bumpers or other securing mechanism to effectively secure and stabilize the bridge members with respect to the drawer and the tabletop. For example, in an alternative to the embodiment described above and illustrated in FIG. 3, a bridge member may include a single bumper disposed at a suitable location along each side of the bridge member lower surface to effectively secure the bridge member between the tabletop and the drawer when the drawer is partially closed and the bridge member is fixed against the tabletop edge.

In a further alternative embodiment, the drawers may be eliminated altogether and the bridge members may be pivotally secured to the tabletop. In such an embodiment, the bridge members may, for example, be slidably moved and/or pivoted from a storing position underneath the tabletop to an operable position aligned with the tabletop where the upper surface of the bridge member is substantially coplanar with the tabletop upper surface. In effect, any suitable securing mechanism that suitably aligns the upper surface of the bridging member with the tabletop upper surface may be utilized in accordance with the present invention.

Having described preferred embodiments of a table with improved wheelchair accessibility, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A table for providing access for a wheelchair including a pair of armrest sections extending from a seat of the wheelchair, the table comprising:

a tabletop including a supporting surface, suspended a selected distance from a surface upon which the wheelchair is supported;

a bridge member releasably securable in an aligned position with the tabletop where the bridge member abuts a peripheral edge of the tabletop and a supporting surface of the bridge member is substantially coplanar with the supporting surface of the tabletop; and a drawer configured to support the bridge member in the aligned position with the tabletop when the bridge member is placed on the drawer;

wherein, in the aligned position with the tabletop, the bridge member is configured to extend within a space defined between the armrest sections of the wheelchair.

2. The table of claim 1, further comprising a plurality of bridge members.

3. The table of claim 1, wherein the drawer is sufficiently dimensioned to receive and store the bridge member when the bridge member is removed from the aligned position with the tabletop.

4. The table of claim 3, wherein the drawer is movable in relation to the tabletop between a position where the drawer is substantially disposed below the tabletop to positions where a portion of the drawer extends from the peripheral edge of the tabletop.

5. The table of claim 1, wherein the bridge member includes at least one securing member to secure the bridge member between portions of the drawer and the peripheral edge of the tabletop when the bridge member is in the aligned position with the tabletop.

6. The table of claim 5, wherein the at least one securing member includes bumpers secured at selected locations along a drawer-engaging surface of the bridge member, and the bumpers prevent sliding of the bridge member between selected walls of the drawer and the peripheral edge of the tabletop.

7. The table of claim 1, further comprising:

at least one leg to suspend the tabletop from the surface upon which the wheelchair is supported; and at least one caster secured to a terminal end of the at least one leg.

8. A table for providing wheelchair access, the table comprising:

a tabletop including a supporting surface;

a drawer movable in relation to the tabletop between a position where the drawer is substantially disposed below the tabletop to positions where portions of the drawer extend from a peripheral edge of the tabletop; and a bridge member supportable by the drawer in a selected alignment with the tabletop when the bridge member is placed on the drawer, the bridge member including a supporting surface that is substantially coplanar with the supporting surface of the tabletop when the bridge member is supported in the selected alignment by the drawer.

9. The table of claim 8, wherein the bridge member includes at least one securing member to secure the bridge member between selected walls of the drawer and the peripheral edge of the tabletop when the bridge member is supported in the selected alignment by the drawer.

10. The table of claim 9, wherein the at least one securing member includes a plurality of bumpers disposed on a drawer engaging surface of the bridge member, and the bumpers prevent sliding of the bridge member between the selected walls of the drawer and the peripheral edge of the tabletop when the bridge member is supported in the selected alignment by the drawer.

11. The table of claim 10, wherein the bumpers are aligned on the drawer engaging surface of the bridge member such that, when the bridge member is supported in the selected alignment and the drawer is moved to a position where a selected portion of the drawer extends from the peripheral edge of the tabletop, the bumpers limit sliding movement of the bridge member between the peripheral edge of the tabletop and an opposing end wall of the drawer as well as between opposing side walls of the drawer.

12. The table of claim 11, wherein the bridge member is supported in the selected alignment by the drawer when a longitudinal dimension of the bridge member is substantially perpendicular to the longitudinal axis of the drawer.

13. The table of claim 8, wherein the drawer is sufficiently dimensioned to receive and store the bridge member when the bridge member is removed from the selected alignment with the tabletop.

14. The table of claim 8, further comprising:

at least one leg to support the tabletop; and at least one caster secured at a terminal end of the at least one leg.

15. A method of providing wheelchair access to a table, wherein the table includes a bridge member and a drawer movable between a position below a tabletop of the table to positions extending from a peripheral edge of the tabletop, the method comprising:

(a) aligning a bridge member in a selected position to extend from a the tabletop between armrest sections of the wheelchair such that a supporting surface of the bridge member is substantially coplanar with a supporting surface of the tabletop, wherein the aligning of the bridge member includes:

(a.1) moving the drawer to a selected position from the peripheral edge of the tabletop: and (a.2) placing the bridge member on the drawer, after the drawer is moved to the selected position, such that the bridge member abuts the peripheral edge of the tabletop.

16. The method of claim 15, wherein (a.2) includes:

(a.2.1) placing the bridge member on the drawer such that a longitudinal dimension of the bridge member is substantially perpendicular to a longitudinal dimension of the drawer.

17. The method of claim 15, wherein the bridge member includes at least one securing member, and the method further comprises:

(b) securing the bridge member between the peripheral edge of the tabletop and portions of the drawer when the bridge member is placed on the drawer.

18. The method of claim 16, wherein the at least one securing member includes a plurality of bumpers, and (b) includes:

(b.1) securing the bridge member such that the bumpers limit sliding movement of the bridge member between the peripheral edge of the tabletop and an opposing end wall of the drawer as well as between opposing side walls of the drawer.

19. The method of claim 15, wherein the drawer is sufficiently dimensioned for receiving the bridge member, and the method further comprises:

(b) removing the bridge member from the selected position on the drawer;

(c) placing the bridge member inside the drawer; and (d) moving the drawer to the position below the tabletop.

20. The method of claim 15, wherein the table includes at least one leg and at least one caster secured to a terminal end of the at least one leg, and the method further comprises:

(b) moving the table to a selected position by engaging the caster with a surface supporting the table.

21. A method of retrofitting a table including a tabletop to render the table wheelchair accessible, the method comprising:

(a) installing a drawer that is movable between a position below the tabletop to positions extending from a peripheral edge of the tabletop; and (b) providing a bridge member that is supportable by the drawer when the bridge member is placed on the drawer and when the drawer is in a selected position extended from the peripheral edge of the tabletop such that a supporting surface of the bridge member is substantially coplanar with a supporting surface of the tabletop.

22. A table for providing access for a wheelchair, the table comprising:

a supporting surface to support items to be placed upon the table, the supporting surface including a tabletop with a peripheral edge;

a means for extending the supporting surface from the peripheral edge of the tabletop to a space located between armrest sections of a wheelchair; and a means for supporting the means for extending, the means for supporting being movable between a position below the supporting surface to positions extending from the peripheral edge of the tabletop;

wherein the means for extending is placed on the means for supporting to achieve a substantially coplanar extension of the surface from the peripheral edge of the tabletop to the space located between armrest sections of the wheelchair.

* * * * *